US006682358B1

(12) United States Patent
Morris

(10) Patent No.: US 6,682,358 B1
(45) Date of Patent: Jan. 27, 2004

(54) INSTRUMENTATION ELECTRICAL CONNECTOR PROTECTOR

(75) Inventor: Richard W. Morris, East Granby, CT (US)

(73) Assignee: Westinghouse Electric Company LLC, Pittsburgh, PA (US)

( * ) Notice: Subject to any disclaimer, the term of this patent is extended or adjusted under 35 U.S.C. 154(b) by 416 days.

(21) Appl. No.: 09/713,552

(22) Filed: Nov. 15, 2000

(51) Int. Cl.[7] ..... H01R 13/44
(52) U.S. Cl. ..... 439/135
(58) Field of Search ..... 220/304, 795, 220/803, 806, DIG. 19; 439/135, 136, 142, 149, 271, 273, 488, 521

(56) References Cited

U.S. PATENT DOCUMENTS

| | | | | |
|---|---|---|---|---|
| 4,245,754 A | * | 1/1981 | Ellis | 220/304 |
| 4,467,937 A | * | 8/1984 | Shaw | 220/246 |
| 4,526,289 A | * | 7/1985 | Schiemann | 220/304 |
| 4,811,865 A | | 3/1989 | Mueller, Jr. et al. | |
| 4,902,238 A | * | 2/1990 | Iacobucci | 439/135 |
| 5,788,064 A | * | 8/1998 | Sacherer et al. | 206/204 |
| 5,979,683 A | * | 11/1999 | Kobayashi et al. | 215/352 |

OTHER PUBLICATIONS

Research, Inc., Product Brochure (3 pages) No Spill Cans and Caps, no date.

* cited by examiner

*Primary Examiner*—Javaid H. Nasri
*Assistant Examiner*—Thanh-Tam Le

(57) ABSTRACT

Apparatus (20) for installation onto an exposed end (22) of an instrumentation connector (24) in a nuclear reactor, to protect the exposed end of the connector from a surrounding body of liquid. The apparatus includes a shell (32) with a closed first end (34) formed from a liquid resistant shell material, a second end (36), and a skirt portion (38) extending therebetween. The second end has an opening (40) for insertion onto the exposed end of the connector. A compression operable seal (50) is positioned in a seal groove adjacent an inside surface (46) of the skirt portion and adjacent the first end. A connection means (48) on the internal surface is adapted to matingly engage an external surface (26) on the connector, and to move said shell material towards the exposed end of the connector when the apparatus is moved to the installed condition. When the apparatus is in the installed condition, the shell material compresses the seal against the external surface to form a substantially leakproof barrier between the exposed end of the connector and the body of liquid.

22 Claims, 2 Drawing Sheets

INSTRUMENTATION ELECTRICAL CONNECTOR PROTECTOR

BACKGROUND

Protective caps or covers have been used in various applications to control the movement of liquids. For example, a cap may be used on a vessel containing a liquid to minimize the evaporation of the liquid and to prevent accidental spillage that may occur when the vessel is moved. As another example, components such as electric components or connectors that are immersed in or expand to liquids must be protected with a cover so as to avoid deleterious effects that could be caused by exposure of the component to the liquid.

One area in particular where electric connectors may be immersed in a liquid, and therefore in need of protection, is in a nuclear reactor.

Nuclear reactors typically include various forms of instrumentation. For example, in-core instruments can be positioned near the fuel bundle or core to measure various parameters associated with the core's performance. These instruments can include, for example, core exit thermocouples and rhodium detectors. The core exit thermocouples measure the temperature of fluid as it exits the core, and the rhodium detectors measure neutron density, which is related to the power level in the core.

Maintenance activities in the reactors sometimes involve moving the core or removing the reactor vessel internals. During such activities the chamber or vessel in which the in-core instrument's electrical connectors are located is flooded with water to minimize the potential for radiation doses to workers performing the maintenance activity. Moreover, the connectors oftentimes have to be de-mated or disconnected as part of the maintenance activities, leaving one end of the connector open and exposed to the surrounding environment.

Prior to the time the vessel is flooded, the exposed ends of the de-mated connectors must be covered or sealed in order to isolate and protect them from the water. These ends are typically protected with a metal cap.

Traditionally, these metal caps have included an o-ring to provide a seal between the connector and the cap in order to protect the exposed end of the connector from the water in which it is immersed. Experience has indicated that the metal caps may leak, particularly if they are not properly installed, or because the o-ring has become loose or disengaged. Moreover, maintenance activities oftentimes involve working with long handled tools which are dipped into the water to perform certain tasks. These tools occasionally impact the metal caps, which can dislodge them from the connector if they are not properly installed. Consequently, the fact that the metal caps are not properly installed oftentimes lead to undesirable results. A cap that leaks or is dislodged will allow water to flood the exposed end of the connector, which may then need to be reworked to replaced to recover its critical electrical capabilities.

The metal caps usually include a lanyard attached to the connector or a nearby surface to capture the cap in the event it is dislodged from the connector. However, the lanyards are oftentimes cut or otherwise removed because they can interfere with, and extend the time needed, for maintenance activities. Time can be of the essence in the nuclear reactor environment, because of both the possibility of radiation exposure to workers, and the loss of revenues while the power plant is off-line. Consequently, an incentive exists to cut any lanyard that is interfering with maintenance activities.

However, if the lanyard is cut and the cap becomes dislodged from the connector, there is nothing to prevent it from sinking into the surrounding body of water. Recovering the cap can be difficult, not only because it sinks into the water, but also because it is typically made with a color that blends into the color of the installation environment. An unrecovered metal cap is undesirable because it poses a potential for foreign object damage, including damage to the fuel assembly and reactor coolant pumps. This in turn can lead to decreased reactor performance and safety risks which are preferably avoided.

From the foregoing, it is seen that a need exists for an improved means of protecting de-mated instrumentation electrical connectors from a surrounding body of water during maintenance activities in nuclear reactors.

SUMMARY

Apparatus is provided that can be installed onto an exposed end of an instrumentation electrical connector, to protect the exposed end of the connector from a surrounding body of liquid. The apparatus can include a shell having a closed first end formed from a liquid resistant shell material, a second end, and a skirt portion extending therebetween. The second end can have an opening therein for insertion onto the exposed end of the connector. A compression operable seal can be positioned in a seal groove adjacent an inside surface of the skirt portion and adjacent the first end. The seal groove can include a trough adjacent the inside surface. A connection means on the internal surface can be adapted to matingly engage an external surface on the connector, and to move the shell material towards the exposed end of the connector when the apparatus is moved to an installed condition. When the apparatus is in the installed condition, the shell material can compress the seal against the exposed end to form a substantially leak proof barrier between the exposed end of the connector and the body of liquid.

Either the shell, seal, or both can have a specific gravity less than the specific gravity of the liquid, but in either case the shell and seal have a combined specific gravity that is less than the specific gravity of the liquid to give the apparatus flotation capability. At least a portion of an outside surface on the shell can be of a color that contrasts with the color of the installation environment.

According to further aspects of the invention, the seal can include a wave washer, and the shell can include a visual installation position indicator and an outside surface with a gripping means.

According to another aspect of the invention, a method is provided for protecting an exposed end of an instrumentation connector in a nuclear reactor from a surrounding body of liquid. The method includes extending an internal surface on a shell over an external surface on the connector, removably connecting the internal surface to the external surface, providing at least a portion of the shell with a liquid resistant shell material, positioning the shell material over the exposed end of the connector, positioning a compression operable seal between the shell material and the exposed end of the connector, and moving the shell to an installed condition wherein the seal is compressed between the shell material and the connector to form a substantially leak-proof seal.

DETAILED DESCRIPTION

Figure 1:
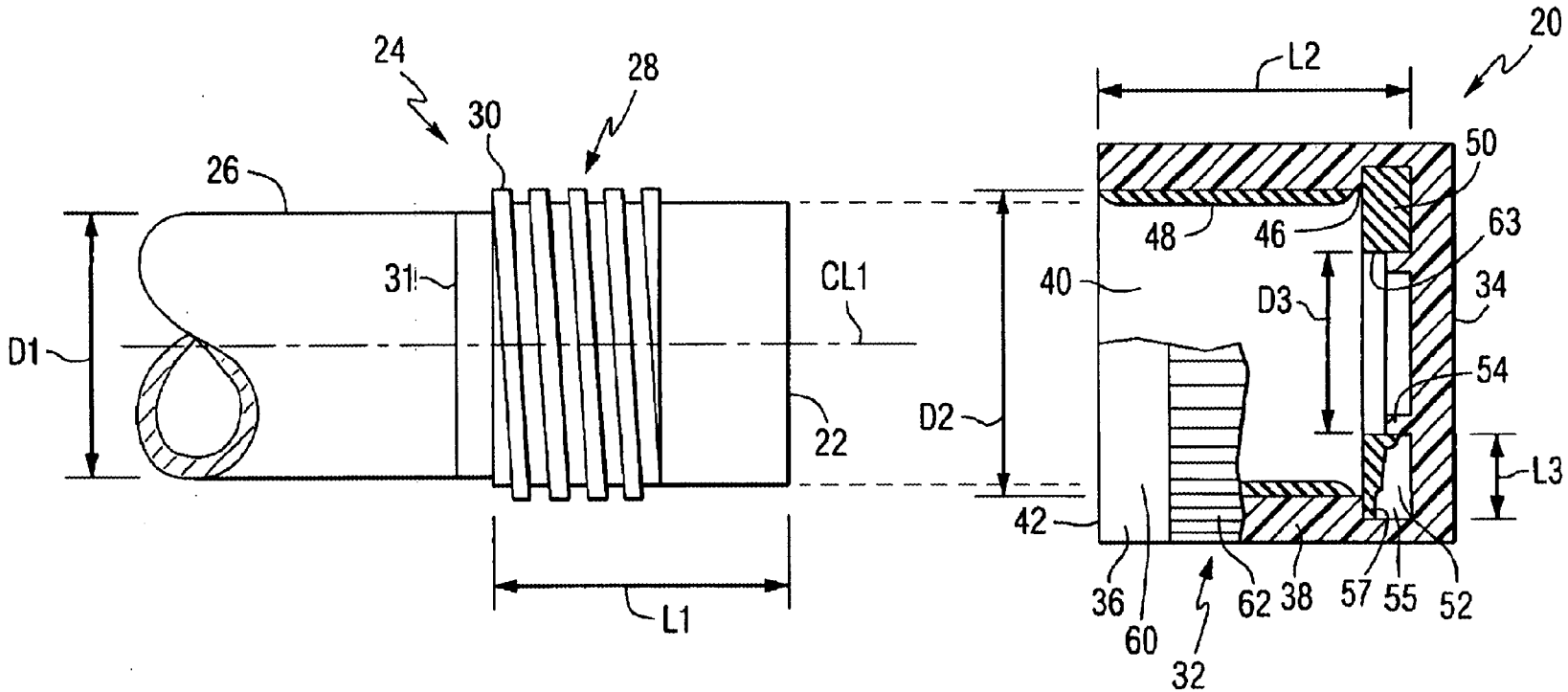
FIG. 1 is a fragmented frontal elevation view of an embodiment having features found on the present invention, in an uninstalled condition.

FIG. 1 shows apparatus (20), which can be installed onto the exposed or de-mated end (22) of an instrumentation connector (24) to protect the connector from a surrounding body of liquid. The connector geometry can vary, but in general such connectors will have an external surface (26) with a diameter (D1). The connector may include threads (28) and a length (L1) from the exposed end (22) to a bottom thread (30).

The apparatus (20) can include a shell (32) with a closed first end (34) formed from a liquid resistant shell material. The liquid resistant shell material is impermeable to water, or other liquids in which the apparatus might be immersed, and can be a material such as polypropylene or the like. The shell material can have a specific gravity less than the specific gravity of the liquid. For example, if the shell is to be immersed in water, the shell material can have a specific gravity of less than one. The purpose of having a specific gravity less than one in a water filled environment is to provide the apparatus with flotation capability.

The first end (34) is referred to as "closed" because it does not contain any holes, perforations, apertures or the like which could establish a pathway between the exposed end of the connector and a surrounding body of liquid. Consequently the closed first end, formed from the liquid resistant shell material, can function as a barrier to water or other liquids. If desired, the entire shell can be a unitary construction made from one liquid resistant shell material.

The shell includes a second end (36) and a skirt portion (38) that can extend for a length (L2) from the first end to the second end. An opening (40) may be positioned in the second end having a diameter (D2). The length (L2) and diameter (D2) can be predetermined depending upon the configuration of the connector (24). The length (L2) can be selected to place the second end surface (42) even with the bottom thread (30) or reference line (31) on the connector when the apparatus is properly installed. Thus, the end surface (42) of the second end can function as a visual installation position indicator to demonstrate the proper installation of the apparatus The skirt portion (38) includes an internal surface (46) with a connection means (48) which can be matingly engaged with the external surface (26) on the connector. The connection means will correspond to the connector configuration and can be, for example, a threaded connection, a quarter turn connection, or other types of connections known to skilled artisans and which can be used to removably attach the shell to the connector. Additionally, the connection means is preferably one which will facilitate the translation, along centerline (CL1), of the first end (34) towards the exposed end (22) when the shell is rotated into an installed condition.

A compression responsive seal (50) can reside adjacent the inside surface (46) of the skirt portion (38) and adjacent the first end (34). The seal can be a gasket placed into a circular seal groove (52) having a lip (54) integrally formed with the first end. The seal groove can also include a trough (55) into which the seal extends. The trough includes a ledge (57) which aids in retaining the seal 30 within the seal groove. The seal is preferably made from neoprene, but it can also be made from other materials known to skilled artisans that are compressible and impermeable to water or other liquids into which the apparatus may be immersed. If desired the seal can also be bonded to the shell using means known to skilled artisans.

The gasket has a diameter (D3) and width (L3) that are selected, in accordance with connector diameter (D1), to place a portion of the width of the gasket into compressive contact with the exposed end (22) of the connector when the apparatus is in an installed condition. If desired, the gasket material can be made with a material having a specific gravity less than the specific gravity of the liquid. In any event, the composite (i.e., combined) specific gravity of the shell (32) and seal (50) will be less than the specific gravity of the liquid into which the apparatus is immersed to ensure that the apparatus will float.

Figure 2:
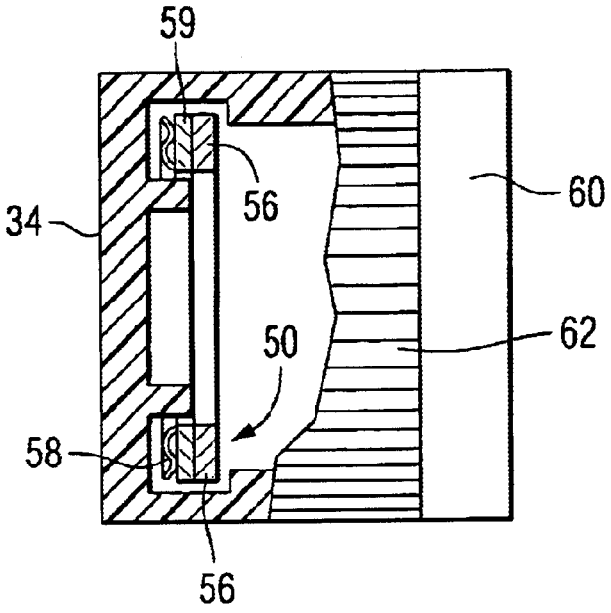
FIG. 2 is a fragmented frontal elevation view of apparatus with an alternative embodiment seal.

FIG. 2 depicts an alternative embodiment in which the seal (50) can comprise a gasket (56) and a wave washer (58). The wave washer (58) can be positioned between the gasket (56) and the first end (34). If a seal with a wave gasket is used, a flat washer (59) can be positioned between the gasket and wave washer in order to minimize contact irregularities then might exist if the wave washer were to bear directly against the gasket.

All or a portion of the shell's outside surface (60) can be provided with a contrasting color. The shell can be made from materials having the desired color, or the desired color can be applied to a prefabricated shell. As used herein, the term "contrasting color" can mean any color which contrasts with the color or colors of the installation environment. Additionally, the outside surface (60) of the shell (32) can be provided with a gripping means to facilitate the gripping and turning operations that an operator may employ when installing and removing the apparatus from a connector. For example, the gripping means can comprise a knurled surface (not shown) or a series of splines (62) integrally formed in the outside surface.

Having described the construction of an apparatus having features found on the present invention, its use in connection with instrumentation connectors in a nuclear reactor will now be described.

The desired configuration of the apparatus is determined based upon the design of the de-mated or exposed connector and the installation environment. The outside surface (60) of the shell (32) is provided with a color that will contrast with, and be easily visible in, the nuclear reactor installation environment. While the exact color can depend upon the color or colors of the installation environment, it is expected that colors such as orange, yellow, red and or white will likely be well suited for use in most nuclear reactors. It is also expected that the apparatus will be immersed in water during maintenance activities performed in nuclear reactors, so the apparatus will typically be fabricated with a composite specific gravity that is less than one. The specific gravity can be adjusted to provide flotation capability in other liquids if necessary.

The opening (40) on the second end (36) is inserted over the connector's exposed end (22), and the shell's internal surface (46) is extended over the connector's external surface (26) until the threads (28) and connection means (48) are in contact with each other. The compression operable seal (50) is positioned between the first end (34) and exposed end (22). The entire shell may be made from the liquid resistant shell material, but in any event, the portion of the first end (34) within the outer circumference of the seal is made with such shell material.

The apparatus can be rotated to engage the threads and removably attach the internal surface to the external surface.

Figure 3:
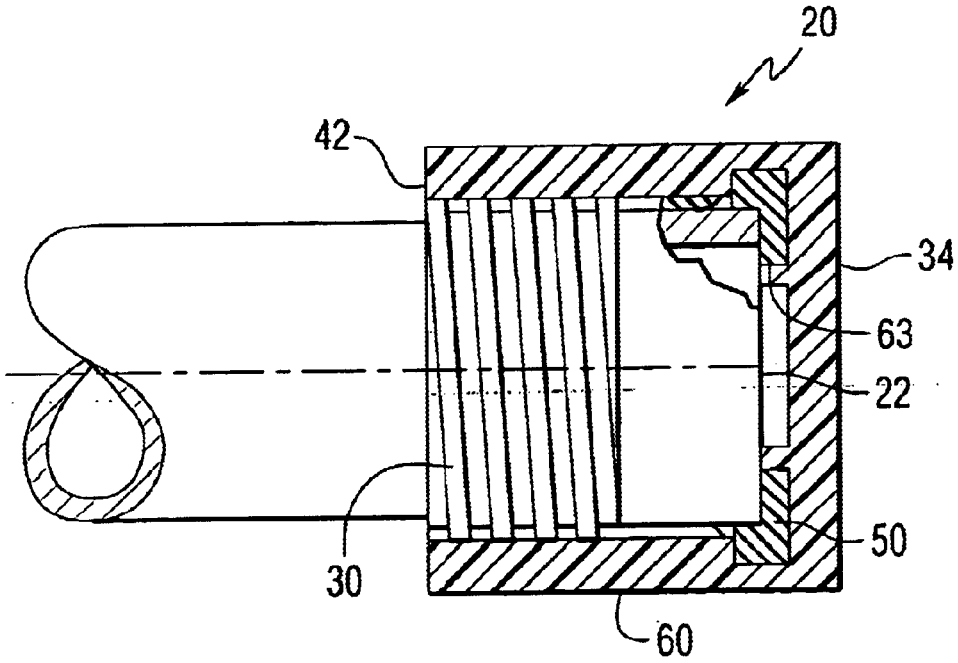
FIG. 3 is a fragmented frontal elevation view, of the embodiment shown in FIG. 1, in an uninstalled condition.

As the apparatus is rotated, the first end (34) of the shell (32) is forced towards the exposed end (22) of the connector (24). The end surface (42) on the shell is visually examined during the installation process to determine its position relative to the bottom thread (30). If desired, another type of position indicator may be used in lieu of bottom thread (30), such as a reference line or mark (31). When the surface is even with the bottom thread, as shown in FIG. 3, this indicates to the operator that the apparatus is in the installed condition. In the installed condition the threads, or other types of connection means which may be used, have the desired degree of engagement to firmly retain the apparatus on the connector. As the apparatus is moved to the installed condition, the internal surface (46) can help guide the connector into the proper engagement with the seal (50). When properly engaged, the connector wall thickness (66) will bear against a portion of the seal that is inward from the outer edges of the seal. As the seal is compressed, it responds by bearing against surfaces in the seal groove and against the connector to form a substantially leak proof barrier between the exposed end of the connector and the body of liquid in which the connector and apparatus are immersed.

The operation of an embodiment that includes a wave washer is essentially the same as that described above. It is expected that a wave washer may be desired when connectors with quarter-turn fastening means are used. Quarter turn fasteners may not develop the level of force necessary to maintain a desired degree of compressive force between the seal and the connector. In such a case the wave washer will provide a supplemental force that will assist in maintaining the sealing arrangement.

After the apparatus is installed on the connector, the pressure vessel or other chamber in which the connector resides can be filled with water. In the event the apparatus becomes dislodged, its buoyancy will carry it to the surface of the water where it can be easily retrieved. The shell's contrasting color will further facilitate retrieval of the apparatus, whether or not it is found loose in a dry or a wet vessel or chamber. Moreover, even if the apparatus is not recovered, it can pose less of a foreign-object-damage risk, since it is constructed of materials such as polypropylene and neoprene, than the metal caps which are traditionally used.

Although the invention has been described in detail, with respect to apparatus and method embodying aspects of the invention, it is to be understood that the description is intended by way of illustration and example only, and is not to be taken by way of limitation. Accordingly, the spirit and scope of the invention are to be limited only by the terms at the appended claims.

What is claimed is:

1. Apparatus for installation onto an exposed end of an instrumentation connector, to protect the exposed end of the connector from a surrounding body of liquid, comprising:

a shell having a closed first end formed from a liquid resistant shell material, a second end, and a skirt portion extending therebetween, said second end having an opening therein for insertion onto the exposed end of the connector;

a compression operable seal positioned in a seal groove adjacent an inside surface of said skirt portion and adjacent said first end, said seal including a wave washer;

a connection means on said internal surface adapted to matingly engage an external surface on the connector, and to move said shell material towards the exposed end of the connector when the apparatus is moved to an installed condition;

whereby, when the apparatus is in the installed condition, said shell material compresses said seal against the exposed end to form a substantially leakproof barrier between the exposed end of the connector and the body of liquid.

2. The apparatus of claim 1, wherein said shell and said seal have a combined specific gravity that is less than the specific gravity of the liquid.

3. The apparatus of claim 2, wherein said seal groove comprises a trough adjacent said inside surface.

4. The apparatus of claim 3, wherein an outside surface on the shell comprises a contrasting color.

5. Apparatus for installation onto an exposed end of an instrumentation connector, to protect the exposed end of the connector from a surrounding body of liquid, comprising:

a shell having a closed first end formed from a liquid resistant shell material, a second end and a skirt portion extending therebetween, said second end having an opening therein for insertion onto the exposed end of the connector, said shell having an outside surface with at least a portion comprising a contrasting color;

a compression operable seal positioned in a seal groove comprising a trough adjacent an inside surface of said skirt portion and adjacent said first end, said seal including a wave washer, said shell and said seal having a combined specific gravity that is less than the specific gravity of the liquid;

a connection means on said internal surface adapted to matingly engage an external surface on the connector, and to move said shell material towards the exposed end of the connector when the apparatus is moved to an installed condition;

whereby, when the apparatus is in the installed condition, said shell material compresses said seal against the exposed end to form a substantially leakproof barrier between the exposed end of the connector and the body of liquid.

6. The apparatus of claim 4, wherein said shell comprises a visual installation position indicator.

7. The apparatus of claim 6, wherein said shell comprises an outside surface with a gripping means.

8. The apparatus of claim 7, wherein said seal is bonded to said shell.

9. Apparatus for protecting a de-mated instrumentation connector immersed in a body of water comprising:

a shell formed from a liquid resistant shell material, having a first end and a skirt portion extending from said first end to a second end, said second end adapted for insertion onto the de-mated end of the connector, and said skirt portion having an internal surface adapted for connecting to an external surface on the connector;

a compression responsive seal adjacent said internal surface and adjacent a portion of the connector that resides between the body of water and the exposed end of the connector when the apparatus is in an installed condition, said seal including a wave washer;

means for compressing said seal to form a substantially leakproof barrier between the exposed end of the connector and the body of water.

10. The apparatus of claim 9, wherein said seal resides in a seal groove.

11. The apparatus of claim 10, wherein said seal groove comprises a trough adjacent said inside surface.

12. The apparatus of claim 11, wherein said shell and said seal have a combined specific gravity that is less than the specific gravity of the liquid.

13. The apparatus of claim 12, wherein an outside surface on said shell comprises a contrasting color.

14. The apparatus of claim 13, wherein said shell comprises a visual installation position indicator.

15. The apparatus of claim 14, wherein said shell comprises an outside surface with a gripping means.

16. Apparatus for protecting a de-mated instrumentation connector immersed in a body of water comprising:

a shell formed from a liquid resistant shell material, having a first end and a skirt portion extending from said first end to a second end, said second end adapted for insertion onto the de-mated end of the connector, and said skirt portion having an internal surface adapted for connecting to an external surface on the connector, said shell having an outside surface with at least a portion comprising a contrasting color;

a compression responsive seal adjacent said internal surface and adjacent a portion of the connector that resides in a seal groove between the body of water and the exposed end of the connector when the apparatus is in an installed condition, said seal includes including a wave washer, said seal groove comprising a trough adjacent said internal surface, said seal and said shell having a combined specific gravity that is less than the specific gravity of the liquid; and means for compressing said seal to form a substantially leakproof barrier between the exposed end of the connector and the body of water.

17. A method for protecting an exposed end of an instrumentation connector in a nuclear reactor from a surrounding body of liquid, comprising:

extending an internal surface on a shell over an external surface on the connector;

removably connecting the internal surface to the external surface;

providing at least a portion of the shell with a liquid resistant shell material;

positioning the shell material over the exposed end of the connector;

positioning a compression operable seal that includes a wave washer between the shell material and the exposed end of the connector;

moving the shell to an installed condition wherein the seal is compressed between the shell material and the connector to form a substantially leak-proof seal.

18. The method of claim 17 comprising providing the shell and the seal with a composite specific gravity that is less than the specific gravity of the liquid.

19. The method of claim 18, comprising providing an outside surface on the shell with a contrasting color.

20. The method of claim 19, comprising visually inspecting the shell installation position indicator.

21. The method of claim 20, comprising providing the outside surface with a gripping means.

22. A method for protecting an exposed end of an instrumentation connector in a nuclear reactor from a surrounding body of liquid, comprising:

extending an internal surface on a shell over an external surface on the connector;

removably connecting the internal surface to the external surface;

providing at least a portion of the shell with a liquid resistant shell material;

positioning the shell material over the exposed end of the connector;

positioning a compression operable seal that includes a wave washer between the shell material and the exposed end of the connector; and moving the shell to an installed condition wherein the seal is compressed between the shell material and the connector to form a substantially leak-proof seal.

* * * * *